US006938314B2

(12) United States Patent
Meichsner et al.

(10) Patent No.: US 6,938,314 B2
(45) Date of Patent: Sep. 6, 2005

(54) METHOD AND APPARATUS FOR CONNECTING TWO OR MORE COMPONENTS BY RIVETS

(75) Inventors: Thomas Meichsner, Heilbronn (DE); Wulf Leitermann, Bad Wimpfen (DE)

(73) Assignee: ThyssenKrupp Automotive AG, Bochum (DE)

( * ) Notice: Subject to any disclaimer, the term of this patent is extended or adjusted under 35 U.S.C. 154(b) by 0 days.

(21) Appl. No.: 10/246,660

(22) Filed: Sep. 18, 2002

(65) Prior Publication Data

US 2003/0051332 A1 Mar. 20, 2003

(30) Foreign Application Priority Data

Sep. 20, 2001 (DE) ..... 101 46 442

(51) Int. Cl.[7] ..... B21J 15/02

(52) U.S. Cl. ..... 29/34 B; 29/716; 29/281.6; 29/525.06; 29/524.1; 72/466.5

(58) Field of Search ..... 72/466.5, 466.4; 29/524.1, 870.039, 872.2, 897.37, 428, 464, 465, 467, 525, 525.01, 525.06, 525.13, 557, 26 A, 26 B, 34 B, 716, 281.5, 281.6

(56) References Cited

U.S. PATENT DOCUMENTS

| | | | | | |
|---|---|---|---|---|---|
| 3,562,893 | A | * | 2/1971 | Winslow et al. | 29/243.53 |
| 3,747,193 | A | * | 7/1973 | Gregory | 29/243.53 |
| 3,828,421 | A | * | 8/1974 | Erlichman | 29/524.1 |
| 4,106,180 | A | * | 8/1978 | Fuhrmeister | 29/432.1 |
| 4,312,107 | A | * | 1/1982 | White | 29/233 |
| 4,757,609 | A | * | 7/1988 | Sawdon | 29/798 |
| 4,885,836 | A | * | 12/1989 | Bonomi et al. | 29/524.1 |
| 4,998,943 | A | * | 3/1991 | Roberts et al. | 29/432.2 |
| 6,408,517 | B1 | * | 6/2002 | Lehmker et al. | 29/897.2 |
| 6,442,823 | B1 | * | 9/2002 | Thompson | 29/524.1 |

* cited by examiner

*Primary Examiner*—David P. Bryant
*Assistant Examiner*—Stephen Kenny
(74) *Attorney, Agent, or Firm*—Max Fogiel

(57) ABSTRACT

A method of fastening at least two large-surface components together by hole-punching rivets, in which the rivets are driven through the components by rivet drivers and against dollies, and fastening the components together. The components rest on supports, and the dollies are a part of these supports; each of the rivet drivers as well as the dollies are guided unfocused to a correct position where a hole-punching rivet is to be placed.

11 Claims, 2 Drawing Sheets

METHOD AND APPARATUS FOR CONNECTING TWO OR MORE COMPONENTS BY RIVETS

BACKGROUND OF THEN INVENTION

The present invention concerns a method of fastening two or more components together by rivets. The invention also concerns a device for carrying out the aforesaid method. Sheet metal components, especially those riveted together, are now being increasingly employed in the field of automotive manufacture. This trend has been augmented by the practice of combining various components into subassemblies. Riveted joints can also be reinforced with adhesives.

U-shaped "tongs" with a rivet driver at the end of one arm and a dolly at the end of the other are often employed to rivet the parts together. Such tongs can be operated by hand or by robots. Since the rivets usually are of types that punch their own holes out of the material, no preliminary punching is necessary.

The aforesaid method, which employs hydraulically or electrically powered tongs, has several drawbacks. The arms of the tongs must be very rigid, and their weight accordingly increases considerably with their length, with how far the riveting point is from the outer edge of the component, that is. Such tongs are very heavy, and their arms tend to sag considerably. The robots need to be very sturdy, and cannot move as quickly as lighter-weight robots.

Another disadvantage is low speed. The tongs have to be opened and, in a complicated procedure, correctly positioned before they can be shifted to the next riveting point. This procedure can be even more troublesome when the machinery includes several robots and several riveting tongs.

SUMMARY OF THE INVENTION

One object of the present invention is accordingly a method of fastening two or more components together by rivets, a method that can be carried out with lighter-weight devices and at higher speeds.

BRIEF DESCRIPTION OF THE DRAWINGS

One embodiment of the present invention will now be specified with reference to the accompanying drawing, wherein.

DESCRIPTION OF THE PREFERRED EMBODIMENTS

Figure 1:
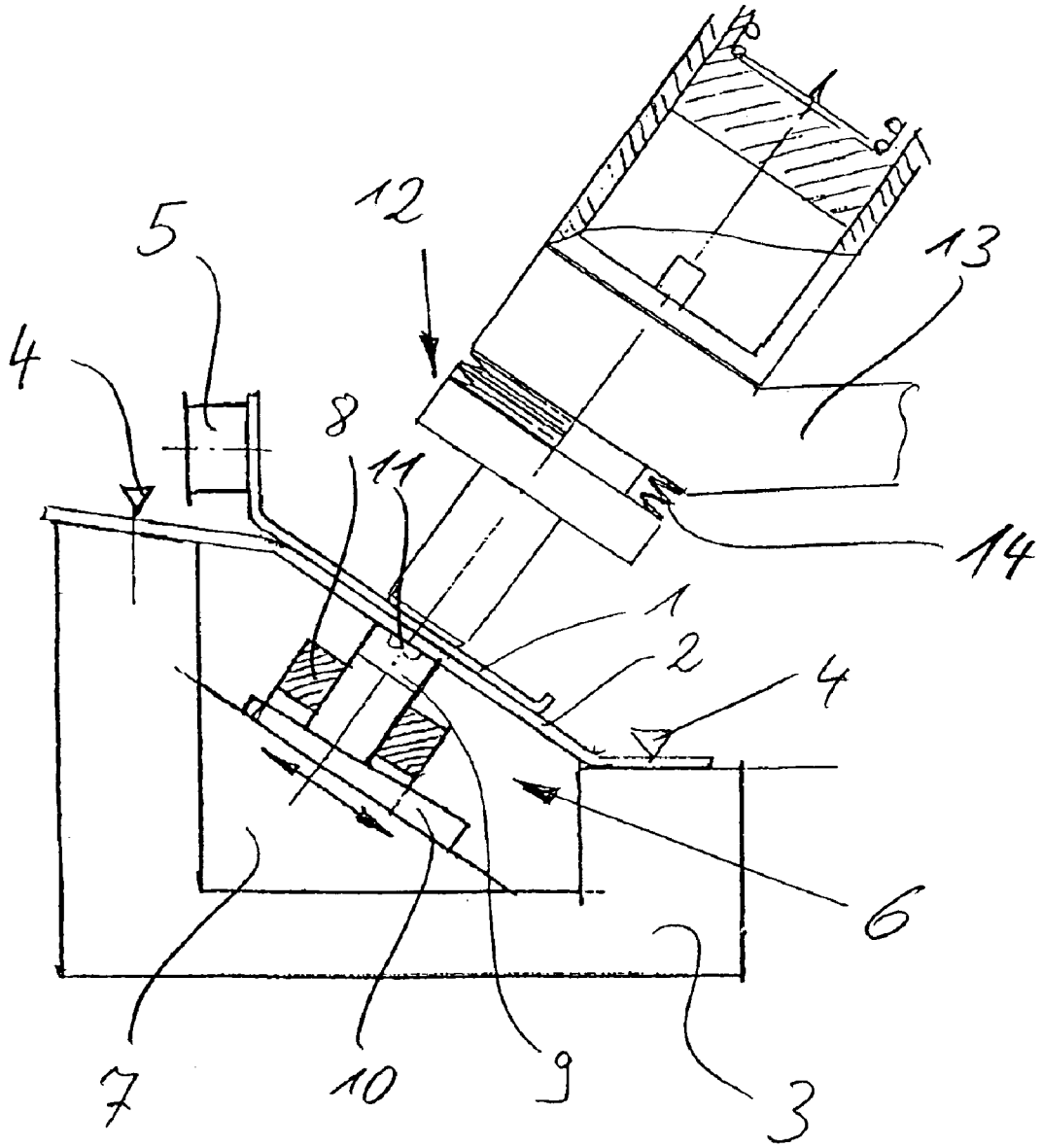
FIG. 1 is a schematic illustration of a riveting device in accordance with the present invention and FIG. 2 depicts a die for positioning an automotive subassembly.

Two or more sheet-metal components 1 and 2 are to be fastened together in the illustrated example. The components rest on a riveting device 3, with component 2, underneath, resting directly against the device and maintained in its intended position by positioning-and-securing heads 4. Component 1, which is to be fastened to component 2, is maintained in position by suction cups 5 for example. It is on the other hand alternatively conceivable to cement components 1 and 2 together at various points before riveting them together.

Riveting dollies 6, preferably identical in design, are positioned at prescribed points below components 1 and 2 and along device 3. Each dolly 6 in the present example comprises a foot 7, an annular rivet holder 8, a punch 9, and a rivet-lifting wedge 10. The exact shape of foot 7 and the precise length of punch 9 will vary in accordance with the particular application, but the dollies' other components will all be identical in design at every riveting point. The position of all the dollies 6 in the device can accordingly be varied vertically and horizontally until they are ideally positioned at and below the riveting-points.

Components 1 and 2 are preferably fastened together with hole punching rivets 11. Rivets 11 are thrust through the intact material and subsequently against a dolly 6 with a matching depression in its head by a rivet driver 12. Rivet driver 12 is supplied with fresh rivets by an unillustrated mechanism and is accommodated in an accommodation 13 at the end of an arm on a robot that secures and positions it. The force necessary to hold components 1 and 2 together properly prior to riveting can be generated by a spring 14 or by other means.

The metal can be punched out and the lower rivet head shaped by either pressing or hammering. Hammering will demand less counteracting force on the part of the rivet driver 12 and robot.

The present method can also be profitably employed without robots. In this event, rivet driver 12 must be positioned and secured by the human hand, with of course the riveting points marked on components 1 and 2.

The device 3 in one specific embodiment employed in a concatenated fabrication-and-assembly line can be assigned other tasks upstream or downstream of the riveting operation. A conventional die previously employed for punching, stamping, or orienting the sheet can for instance be provided with appropriate dollies 6. Such an approach can decrease tooling investment.

Thicker components can when necessary be provided with rivet holes before being fastened together. When the materials are being processed manually, this approach entails the advantage that no marks are needed. When working through robots on the other hand, they must be more precisely controlled.

Figure 2:
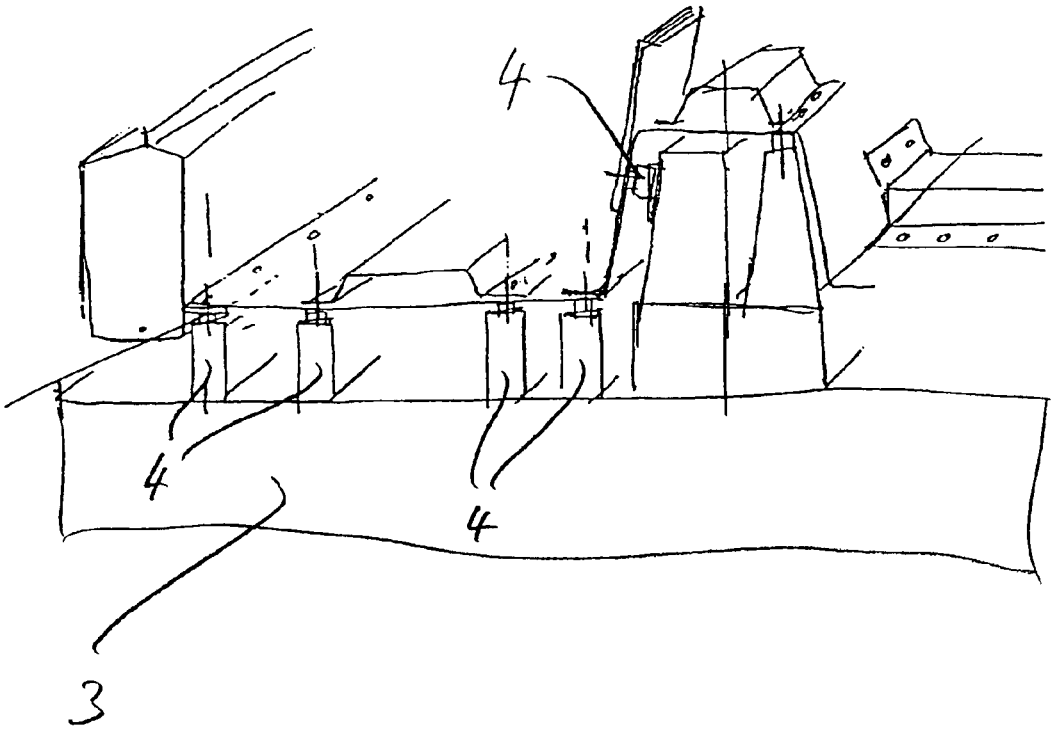

FIG. 2 is a schematic view of a device 3 for attaching a floor assembly to an automobile. Such subassemblies include a large number of flat and molded sheetmetal components that need to be fastened together by rivets, and the associated device will accordingly be complex. In this event dollies of identical design and easy to adjust in height and position represent a particular advantage. It will be evident that dollies 6 can also or alternatively be secured to device 3 as for example, horizontally. It is in particular a complicated floor subassembly like the one illustrated in FIG. 2 that best demonstrates the advantage achieved by the present invention. Simply, several robots can be employed together without one interfering with another in that rivet drivers 12 can be considerably smaller than those in conventional devices.

What is claimed is:

1. Apparatus for connecting at least two components with rivets, comprising: a plurality of dollies; a rivet driver for driving a rivet through said components and against each of said dollies; riveting device with supporting elements on which said components rest and having positioning and securing elements for holding said components in a position preparatory to riveting, each dolly being separate from said riveting device; said components to be riveted together being free of pre-formed holes at locations where riveting is to be carried out by said rivet driver; each dolly being movable independent of said supporting elements to locations where riveting is to be carried out, said dollies being adjustable in height and position, each said dolly being adjustable to a height and position independent of the other dollies, rivet feeds and dolly feeds being independent of each other, positions of all dollies being adjustable vertically and horizontally until said dollies are positioned ideally in specific positions at and below respective riveting points.

2. Apparatus as defined in claim 1, wherein said riveting device and said rivet driver are part of a concatenated fabrication and assembly line.

3. Apparatus as defined in claim 1, including robot means for holding and guiding said rivet driver.

4. Apparatus as defined in claim 1, including automatic rivet feeding means for feeding said rivet driver with rivets.

5. Apparatus as defined in claim 1, wherein said rivet driver is pressed against said components to be riveted with a predetermined force before carrying out a riveting procedure.

6. Apparatus as defined in claim 1, wherein said dolly is adjustable in position and height.

7. Apparatus as defined in claim 1, wherein said riveting device is in a concatenated fabrication and assembly line and has a different function at upstream or downstream work stations.

8. Apparatus as defined in claim 7, wherein said riveting device is in a stamping, bending or straightening work station.

9. Apparatus as defined in claim 1, wherein said rivet driver is axially connected resiliently to accommodation means.

10. Apparatus for connecting at least two components with rivets, comprising: a plurality of dollies; a rivet driver for driving a rivet through said components and against each of said dollies; a riveting device with supporting elements on which said components rest and having positioning and securing elements for holding said components in a position preparatory to riveting, each dolly being separate from said riveting device; said components to be riveted together being free of pre-formed holes at locations where riveting is to be carried out by said rivet driver; each dolly being movable independent of said supporting elements to locations where riveting is to be carried out; said riveting device arid said rivet driver being part of a concatenated fabrication and assembly line; robot means for holding and guiding said rivet driver; automatic rivet feeding means for feeding said rivet driver with rivets; said rivet driver being pressed against said components to be riveted with a predetermined force before carrying out a riveting each dolly being adjustable in position and height; said riveting device being in a concatenated fabrication and assembly line and having a different function at upstream or downstream work stations; said riveting device being in a stamping, bending, or straightening work station; said rivet driver being axially connected resiliently to accommodation means, said dollies being adjustable in height and position, each said dolly being adjustable to a height and position independent of the other dollies, rivet feeds and dolly feeds being independent of each other, positions of all dollies being adjustable vertically and horizontally until said dollies are positioned ideally in specific positions at and below respective riveting points.

11. Apparatus for connecting at least two components with rivets, comprising: a plurality of dollies; a rivet driver for driving a rivet through said components and against each dolly; a riveting device with supporting elements on which said components rest and having positioning and securing elements for holding said components in a position preparatory to riveting, each dolly being separate from said riveting device; said components to be riveted together being free of pre-formed holes at locations where riveting is to be carried out by said rivet driver; each dolly being movable independent of said supporting elements to locations where riveting is to be carried out; said dollies being identically constructed, said dollies being adjustable in height and position, each said dolly being adjustable to a height and position independent of the other dollies, rivet feeds and dolly feeds being independent of each other, positions of all dollies being adjustable vertically and horizontally until said dollies are positioned ideally in specific positions at and below respective riveting points.

* * * * *